US008307667B2

(12) United States Patent
Rusignuolo et al.

(10) Patent No.: US 8,307,667 B2
(45) Date of Patent: Nov. 13, 2012

(54) METHOD AND SYSTEM FOR REMOTE ACQUISITION OF REFRIGERATED VEHICLE DATA VIA TELEMATICS

(75) Inventors: Giorgio Rusignuolo, Manlius, NY (US); Patrick McDonald, Athens, GA (US); Kevin L. Barnett, Liverpool, NY (US); Eden T. Nguyen, Athens, GA (US)

(73) Assignee: Carrier Corporation, Farmington, CT (US)

( * ) Notice: Subject to any disclaimer, the term of this patent is extended or adjusted under 35 U.S.C. 154(b) by 868 days.

(21) Appl. No.: 12/431,936

(22) Filed: Apr. 29, 2009

(65) Prior Publication Data

US 2009/0272132 A1 Nov. 5, 2009

Related U.S. Application Data

(60) Provisional application No. 61/049,075, filed on Apr. 30, 2008.

(51) Int. Cl.
*F25B 1/00* (2006.01)

(52) U.S. Cl. ..... 62/115

(58) Field of Classification Search ..... 62/77, 115, 62/231, 498; 707/10, 999.01
See application file for complete search history.

(56) References Cited

U.S. PATENT DOCUMENTS 7,406,834 B2 * 8/2008 Williams ..... 62/115
* cited by examiner

*Primary Examiner* — Melvin Jones
(74) *Attorney, Agent, or Firm* — Carlson, Gaskey & Olds, P.C.

(57) ABSTRACT

A method or apparatus of accessing data includes detecting at least one parameter of a component of a refrigerated container and providing data relating to the at least one parameter to a transmitting computer located on the refrigerated container. The method or apparatus can further include transferring the data from the transmitting computer to a first remote computer located at an off-site location and transferring the data from the first remote computer to a second remote computer located at another off-site location.

26 Claims, 2 Drawing Sheets

METHOD AND SYSTEM FOR REMOTE ACQUISITION OF REFRIGERATED VEHICLE DATA VIA TELEMATICS

REFERENCE TO RELATED APPLICATION

This application claims priority to U.S. Provisional Application No. 61/049,075 filed Apr. 30, 2008.

BACKGROUND OF THE INVENTION

This invention relates generally to a method and system for remotely acquiring data relating to a refrigerated vehicle.

A refrigerated vehicle is used to transport refrigerated cargo, such as frozen or refrigerated food, from one location to another. The refrigerated vehicle includes a refrigerated container having a space for goods. The container also includes a refrigeration unit that functions to cool the space.

The refrigeration unit includes a refrigeration system, and an evaporator of the refrigeration system cools the refrigerated box and the goods.

SUMMARY OF THE INVENTION

Exemplary embodiments of the invention include an apparatus and method of accessing data including detecting at least one parameter of a component of a refrigerated container and providing data relating to the at least one parameter to a transmitting computer located on the refrigerated container. The invention can further include transferring the data from the transmitting computer to a first remote computer located at an off-site location and transferring the data from the first remote computer to a second remote computer located at another off-site location.

Other exemplary embodiments of the invention include a system for accessing data including at least one sensor to detect at least one parameter of a component of a refrigerated container and a transmitting computer located on the refrigerated container. Data relating to the at least one parameter is provided to the transmitting computer, the transmitting computer including a transmitter. The system includes a first remote computer located at an off-site location, the first remote computer including a transmitter and a receiver. The first remote computer receives the data from the transmitting computer. The system includes a second remote computer located at another off-site location, the second remote computer including a receiver. The second remote computer receives the data from the first remote computer.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
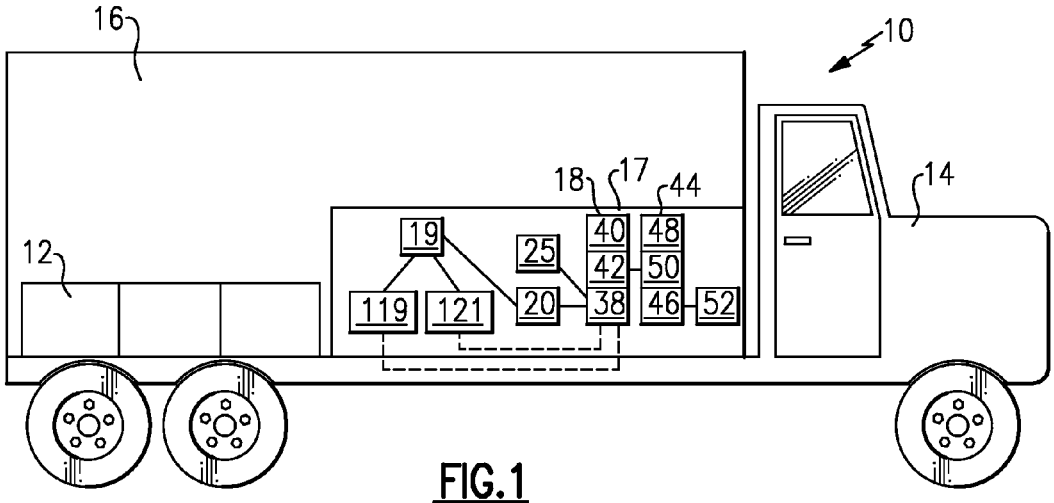
FIG. 1 illustrates a refrigerated vehicle.

FIG. 1 illustrates a refrigerated vehicle 10 that cools or refrigerates cargo or goods 12, such as frozen or refrigerated goods, during transport from one location to another. The refrigerated vehicle 10 includes a cab portion 14. The cab portion 14 pulls a refrigerated box 16 or trailer or container that contains the goods 12. A refrigeration unit 17 is located in the refrigerated box 16. In one example, the refrigeration unit 17 is attached to the front of the refrigerated box 16. A refrigeration system 20 cools the refrigerated box 16. The refrigeration unit 17 includes a first computer 18 that monitors and controls the refrigeration system 20 and obtains data relating to operating conditions of components of the refrigeration system 20 and the refrigerated vehicle 10, such as temperature or pressure, as described blow. The data is collected by sensors (described below). The refrigeration unit 17 also includes a second computer 44 that is in communication with the first computer 18 and transmits data obtained by the first computer 18 to a remote location, as discussed below. The second computer 44 can be provided by PAR Technology Corporation. In one example, the second computer 44 provided by PAR Technology Corporation has Model No. CHDG LMS-WO-08-0110C. The second computer 44 includes the features described below.

The first computer 18 includes a first microprocessor 38, storage 40 and memory 42. The first microprocessor 38 can be a hardware device for executing software (particularly software stored in the memory 42), to communicate data to and from the memory 42, and to generally control operations of the first computer 18 pursuant to the software. Software in the memory 42 is read by the first microprocessor 38 and then executed. The memory 42 can include volatile memory elements, such as random access memory or RAM. The storage 40 can include non-volatile memory elements.

The second computer 44 includes a second microprocessor 46, storage 48 and memory 50. The second microprocessor 46 can be a hardware device for executing software (particularly software stored in the memory 50), to communicate data to and from the memory 50, and to generally control operations of the second computer 44 pursuant to the software. Software in the memory 50 is read by the second microprocessor 46 and then executed. The memory 50 can include volatile memory elements, such as random access memory or RAM. The storage 48 can include non-volatile memory elements. The second computer 44 also includes a transmitter 52 that transmits data provided to the second microprocessor 46 to a first remote computer 118, as described below. In one example, the first remote computer 118 is a central server.

Figure 2:
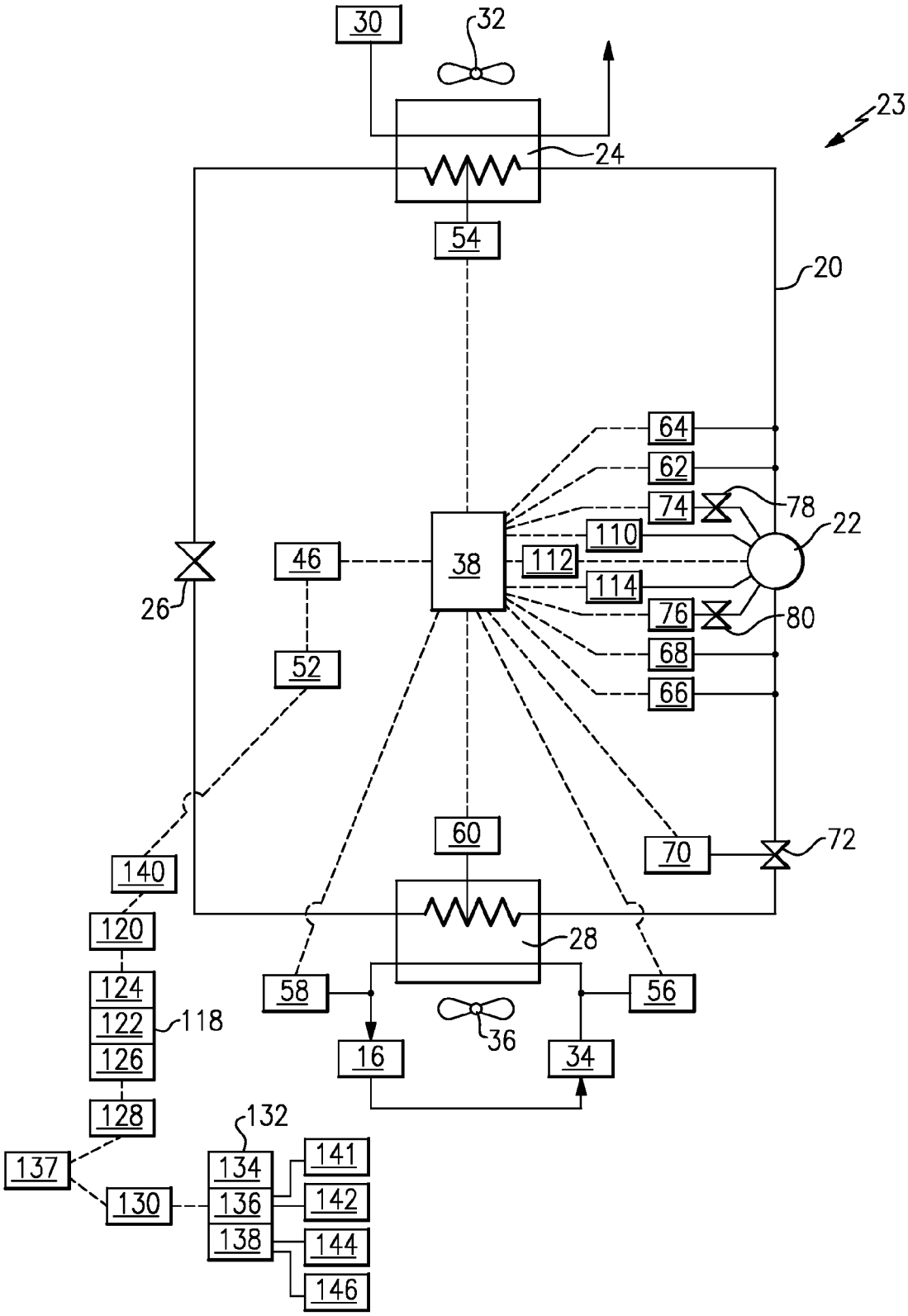
FIG. 2 illustrates a system including the refrigerated vehicle, a refrigeration system and a plurality of computers.

FIG. 2 illustrates a system 23 including the refrigeration system 20 of the refrigeration unit 17. The refrigeration system 20 includes a compressor 22, a first heat exchanger 24, an expansion device 26, and a second heat exchanger 28 that provides cool air to the refrigerated box 16 to cool the goods 12. Refrigerant circulates through the closed circuit refrigeration system 20.

The compressor 22 compresses the refrigerant to a high pressure and a high enthalpy, and the refrigerant exits the compressor 22 and flows through the first heat exchanger 24. When the refrigeration system 20 is operating in a cooling mode, the first heat exchanger 24 acts a condenser. In the first heat exchanger 24, the refrigerant rejects heat to air 30 and is condensed into a liquid that exits the first heat exchanger 24 at a low enthalpy and a high pressure. A fan 32 directs the air through the first heat exchanger 24, and the heated air is exhausted from the refrigerated vehicle 10. The cooled refrigerant then passes through the expansion device 26, which expands the refrigerant to a low pressure. After expansion, the refrigerant flows through the second heat exchanger 28, which acts as an evaporator. In the second heat exchanger 28, the refrigerant accepts heat from air 34 drawn from the refrigerated box 16 by a fan 36, cooling the air. The refrigerant exits the second heat exchanger 28 at a high enthalpy and a low pressure. The cooled air 34 is supplied to the refrigerated box 16. After cooling the refrigerated box 16, the air 34 returns to the second heat exchanger 28 for additional cooling. The refrigerant then flows to the compressor 22, completing the cycle.

When the refrigeration system 20 is operating in a heating mode, the flow of the refrigerant is reversed by opening and/or closing a plurality of valves (not shown). The first heat exchanger 24 accepts heat from the air 30 and functions as an evaporator, and the second heat exchanger 28 rejects heat to the air 34 and functions as a condenser.

Information and data about the refrigeration unit 17 and the refrigeration system 20 is provided to the first microprocessor 38. The serial number of the refrigeration unit 17, the identification number of the refrigeration unit 17, the software version running on the first computer 18, a time stamp of the refrigeration unit 17, the overall status of the refrigeration unit 17 (on, off, PC mode, configuration mode, etc.), a mode of operation of the refrigeration unit 17 (cool, heat, etc.), and information about the status of active or inactive alarms (such as shut down or non-shut down alarms) are provided to the first microprocessor 38. The temperature set point of the refrigerated box 16 can be inputted by an individual with an input device 25 and provided to the first microprocessor 38. For example, the temperature set point can be inputted with a keyboard, mouse, or other input device 25. Sensors detect information about the refrigeration system 20, and data about this information is provided to the first microprocessor 38.

As an illustration, a sensor 54 located near the middle of a coil of the first heat exchanger 24 (the condenser) detects the ambient air temperature. A sensor 56 detects the return air temperature of the airflow between the refrigerated box 16 and the refrigeration unit 17, a sensor 58 detects the supply air temperature of the airflow between the refrigeration unit 17 and the refrigerated box 16, and a sensor 60 located on a coil of the second heat exchanger 28 (the evaporator) detects the defrost termination temperature.

In other illustrations, a sensor 62 detects the discharge pressure of the compressor 22, a sensor 64 detects the discharge temperature of the compressor 22, a sensor 66 detects the suction pressure of the compressor 22, and a sensor 68 detects the suction temperature of the compressor 22. A sensor 70 detects the percentage opening of a suction modulation valve 72. Sensors 74 and 76 located at a compressor head (not shown) determine the mode of compressor unloader valves 78 and 80, respectively that unload pressure in the compressor heads.

Figure 3:
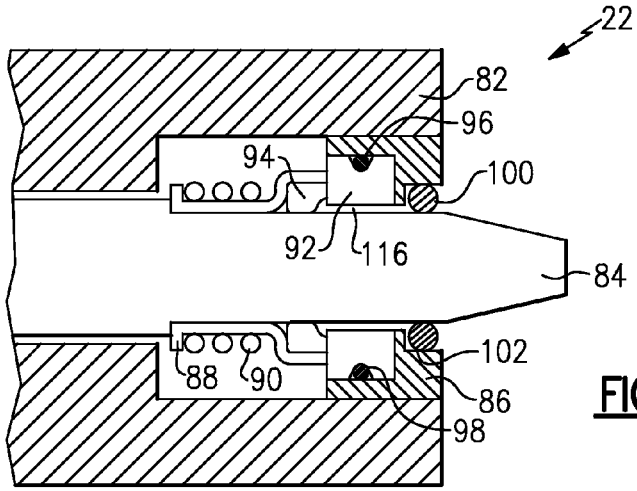
FIG. 3 illustrates a side view of components of a compressor.

As an example of the present invention, FIG. 3 illustrates a portion of the compressor 22. The compressor 22 includes a housing 82, a crankshaft 84 and a gland plate 86. A body portion 88 with a surrounding spring 90 surrounds the crankshaft 84. The compressor 22 includes a stationary compressor shaft seal 92 located between the crankshaft 84 and the gland plate 86 and a rotary seal 94 located between the crankshaft 84 and the body portion 88. The stationary compressor shaft seal 92 is spaced from the crankshaft 84 by a space 116. The spring 90 provides axial loading between the stationary compressor shaft seal 92 and the rotary seal 94 to provide a refrigerant seal. An o-ring 96 is received in a groove 98 of the stationary compressor shaft seal 92 and positioned between the stationary compressor shaft seal 92 and the gland plate 86. A lip seal 100 can be positioned in a groove 102 in the gland plate 86 and positioned between the crankshaft 84 and the gland plate 86 to prevent the ingress of dirt.

Figure 4:
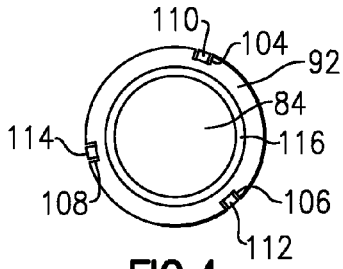
FIG. 4 illustrates a cross-sectional view of a crankshaft showing the orientation of sensors in a stationary compressor shaft seal.

As shown in FIG. 4, in one example, the stationary compressor shaft seal 92 includes three holes 104, 106 and 108 that each receive a sensor 110, 112 and 114, such as a thermistor. The sensors 110, 112 and 114 detect the temperature at the stationary compressor shaft seal 92. In this example, the sensors 110, 112 and 114 are employed to provide multiple temperature readings and to determine if there is any variation in temperature around the profile of the crankshaft 84. The temperature detected by the sensors 110, 112 and 114 should be equal, and any variation in the temperature readings detected by the sensors 110, 112 and 114 could indicate a failure at the stationary compressor shaft seal 92 that requires service.

In one example, the sensors 110, 112 and 114 are positioned approximately 120° relative to each other. As there are three sensors 110, 112 and 114, the 120° orientation provides equal spacing of the sensors 110, 112 and 114 about the crankshaft 84.

In one example, the temperature detected by the sensors 110, 112 and 114 should be at or below a threshold temperature, which is determined by previous testing. If the sensors 110, 112 or 114 detect a temperature greater than the threshold temperature, this could indicate that there could be a failure at the stationary compressor shaft seal 92 that requires service. The threshold temperature depends on the type of system and is determined by previous testing. In one example, the threshold temperature around the stationary compressor shaft seal 92 of the compressor 22 employed in the refrigerated vehicle 10 is approximately 225° F., which is determined by previous testing. However, the threshold temperature depends on specifics of the refrigeration system 20, and one skilled in the art would understand how to determine the threshold temperature for the specific system. The temperatures detected by the sensors 110, 112 and 114 are provided to the first microprocessor 38.

The sensors 110, 112 and 114 should detect the same temperature. If there is any variation between the temperature readings of the sensors 110, 112 and 114, this could indicate a failure at the stationary compressor shaft seal 92 that requires service.

Returning to FIG. 1, the refrigeration unit 17 includes an engine 19. In one example, the engine 19 is a diesel engine. A sensor 119 detects the engine coolant temperature. The engine coolant temperature indicates the horsepower load on the engine 19, which directly correlates to the power required by the compressor 22. A sensor 121 detects the RPM of the engine 19. The RPM of the engine 19 indicates if and how the compressor 22 is running. The compressor 22 can run at a high speed or a low speed. For example, if the RPM of the engine 19 is zero, then the engine 19, and therefore the compressor 22, is not operating. If the RPM of the engine 19 is at a first value, then the compressor 22 is operating at the low speed. If the PRM of the engine 19 is at a second value, then the compressor 22 is operating at the high speed. Data about this information is provided to the first microprocessor 38.

The refrigeration unit 17 can include other sensors that can detect parameters of other components of the refrigeration system 20. Data about this information can be stored on the memory 42 and accessed at a later time.

Returning to FIG. 2, the information and data provided to the first microprocessor 38 from the various sensors is provided to the second microprocessor 46. In one example, the second microprocessor 46 receives data every 5 seconds from the first microprocessor 38.

In addition to receiving data from the first microprocessor 38, the second computer 44 determines the location of the refrigerated vehicle 10. The second microprocessor 46 directly obtains information and data regarding the latitude of a GPS location of the refrigeration unit 17 and the longitude of a GPS location of the refrigeration unit 17. For example, GPS technology is incorporated into the second computer 44 provided by PAR Technology Corporation. In one example, this information is provided to the second microprocessor 46 at least once a day. This allows the location of the refrigerated vehicle 10 to be monitored. For example, if other sensors determine that the engine 19 is delivering less power (which decreases the performance of the refrigeration unit 17) and the GPS technology indicates that the refrigerated vehicle 10 is located at a location that is at a high altitude, this could indicate why the engine 19 is delivering less power, as opposed to there being a failure. The second microprocessor 46 also receives information and data about a datagate timestamp.

The transmitter 52 of the second computer 44 transmits the information and data obtained by the second microprocessor 46 (both the information and data provided by the first microprocessor 38 to the second microprocessor 46 and the information and data provided directly to the second microprocessor 46) to a first remote computer 118.

If the refrigeration unit 17 is inactive and the engine 19 is not running, the GPS information does not need to be provided to the first remote computer 118. However, if these conditions are not achieved and no GPS data has been collected within the previous 23 hours, the GPS data will be transmitted to the first remote computer 118 after the next regular data transmission session.

The first remote computer 118 is located at an off-site location. The data and information can be transmitted from the second microprocessor 46 to the first remote computer 118 over a wireless network 140, such as, but not limited to, a cellular, RF, satellite, etc. network.

The first remote computer 118 includes a receiver 120 that receives the data and information transmitted from the second computer 44 by the transmitter 52 through the wireless network 140. The first remote computer 118 includes a third microprocessor 122, memory 124 and storage 126. The third microprocessor 122 can be a hardware device for executing software (particularly software stored in the memory 124), to communicate data to and from the memory 124, and to generally control operations of the first remote computer 118 pursuant to the software. Software in the memory 124 is read by the third microprocessor 122 and then executed. The memory 124 can include volatile memory elements, such as random access memory or RAM. The storage 126 can include non-volatile memory elements. The first remote computer 118 also includes a transmitter 128 that can transmit the data and information from the first remote computer 118 to a second remote computer 132. The first remote computer 118 also formats the data and information for analysis. For example, the first remote computer 118 converts the information and data from hexidecimal to base 10, which is readable by a technician who accesses the data at the second remote computer 132. Once the information and data is stored on the first remote computer 118, the first remote computer 118 erases the memory 50 of the second computer 44. Therefore, there are no data storage constraints.

The information and data about the refrigerated vehicle 10 and the refrigeration system 20 is stored on the first remote computer 118. The data can be accessed remotely from a second remote computer 132 at another off-site location through a computer network 137, such as WAN (i.e., Internet) or LAN, by a user.

The second remote computer 132 includes a receiver 130 that receives the data and information transmitted from the first remote computer 118 by the transmitter 128 over the computer network 137. The second remote computer 132 includes a fourth microprocessor 136, memory 138 and storage 134. The fourth microprocessor 136 can be a hardware device for executing software (particularly software stored in the memory 138), to communicate data to and from the memory 138, and to generally control operations of the second remote computer 132 pursuant to the software. Software in the memory 138 is read by the fourth microprocessor 136 and then executed. The memory 138 can include volatile memory elements, such as random access memory or RAM. The storage 134 can include non-volatile memory elements.

The information and data about the refrigerated vehicle 10 and the refrigeration system 20 can be accessed in real time over the Internet 137 by accessing a website. A keyboard 144 and/or a mouse 146 can be employed to access the information and data. The operator accesses the website through the second remote computer 132 and then inputs a username and password. Once authorized, the operator can access the data about the refrigerated vehicle 10 and the refrigeration system 20 that is stored on the first remote computer 118. The data can be downloaded on the second remote computer 132.

The data can be displayed in any manner, such as a real time reading of each of the parameters mentioned above or an average of each of the parameters mentioned above. The data can be displayed on a monitor 141 or printed by a printer 142.

By employing telematics, the user can remotely obtain real time data about the refrigerated vehicle 10 and the refrigeration system 20 to determine how the refrigerated vehicle 10 and the refrigeration system 20 are performing. Therefore, a user does not have to travel to the refrigerated vehicle 10 to obtain the information. The remote access to data can have a polling rate as high as 1 second per data point.

The user can use the remotely accessed information and data to assist in the design and manufacture of future systems. In another example, through the second remote computer 132, the user can control the settings of the refrigeration unit 17 to obtain the desired performance of the refrigeration system 20. The location of the refrigeration unit 17 can also be monitored.

In one example, the user can monitor the operation of the refrigeration device or component, such as the compressor 22, by monitoring the temperature detected by each of the sensors 110, 112 and 114. If any of the sensors 110, 112 and 114 detect a temperature that is above or below a threshold value (such as 225° F.), this may indicate that the compressor 22 is not operating properly or most efficiently. The user can use this information to help in the design of future refrigeration units 17 to achieve optimal results. The information provided by the sensor 68 that detects the suction temperature of the compressor 22 can also be used in determining how the compressor 22 is operating.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A method of accessing data, the method comprising:

detecting at least one parameter of a component of a refrigerated container;

providing data relating to the at least one parameter to a transmitting computer located on the refrigerated container;

transferring the data from the transmitting computer to a first remote computer located at an off-site location; and transferring the data from the first remote computer to a second remote computer located at another off-site location.

2. The method as recited in claim 1 further including providing the data relating to the at least one parameter to a refrigeration unit computer, and providing the data relating to the at least one parameter to the transmitting computer includes transferring the data relating to the at least one parameter from the refrigeration unit computer to the transmitting computer.

3. The method as recited in claim 2 further including installing a refrigeration unit on the refrigerated container, wherein the refrigeration unit includes a refrigeration system, the transmitting computer and the refrigeration unit computer.

4. The method as recited in claim 1 further including compressing a refrigerant, cooling the refrigerant, expanding the refrigerant and heating the refrigerant, wherein the step of heating the refrigerant includes exchanging heat between the refrigerant and air to heat the refrigerant and cool the air, wherein the cooled air cools a portion of the refrigerated container.

5. The method as recited in claim 1 wherein detecting the at least one parameter includes detecting an operating condition of a component of the refrigerated container.

6. The method as recited in claim 5 wherein detecting the operating condition of the component includes detecting a temperature at a compressor with at least one sensor.

7. The method as recited in claim 6 wherein detecting the temperature at the compressor includes detecting a temperature at a compressor shaft seal.

8. The method as recited in claim 7 wherein the at least one sensor comprises three sensors, and the three sensors are spaced uniformly apart.

9. The method as recited in claim 8 wherein the three sensors are spaced 120° apart.

10. The method as recited in claim 1 wherein the step of detecting the at least one parameter includes detecting a suction temperature of a compressor.

11. The method as recited in claim 1 wherein the step of transferring the data from the transmitting computer to the first remote computer includes transmitting the data over a cellular network.

12. The method as recited in claim 1 wherein the step of transferring the data from the first remote computer to the second remote computer includes transmitting the data over the Internet.

13. The method as recited in claim 1 further including the step of accessing the data on the second remote computer in real time.

14. A system for accessing data, the system comprising:

at least one sensor to detect at least one parameter of a component of a refrigerated container;

a transmitting computer located on the refrigerated container, wherein data relating to the at least one parameter is provided to the transmitting computer, the transmitting computer including a transmitter;

a first remote computer located at an off-site location, wherein the first remote computer includes a transmitter and a receiver, and the first remote computer receives the data from the transmitting computer; and a second remote computer located at another off-site location, wherein the second remote computer includes a receiver, and the second remote computer receives the data from the first remote computer.

15. The system as recited in claim 14 further including a refrigeration unit computer that obtains the data relating to the at least one parameter from the at least one sensor, and the refrigeration unit computer provides the data relating to the at least one parameter from the at least one sensor to the transmitting computer.

16. The system as recited in claim 15 further including a refrigeration unit on the refrigerated container, wherein the refrigeration unit includes a refrigeration system, the refrigeration unit computer and the transmitting computer.

17. The system as recited in claim 14 further including a refrigeration system including a compressor for compressing a refrigerant, a condenser for cooling the refrigerant, an expansion device for expanding the refrigerant and an evaporator for cooling the refrigerant, wherein heat is exchanged in the evaporator between the refrigerant and air to heat the refrigerant and cool the air, and the cooled air cools a portion of the refrigerated container.

18. The system as recited in claim 14 wherein the at least one parameter is an operating condition of a component of a refrigerated container.

19. The system as recited in claim 18 wherein the operating condition is a temperature and the component is a compressor.

20. The system as recited in claim 19 wherein the component is a compressor shaft seal of the compressor.

21. The system as recited in claim 20 wherein the at least one sensor includes three sensors, and the three sensors are spaced uniformly apart.

22. The system as recited in claim 21 wherein the three sensors are spaced 120° apart.

23. The system as recited in claim 19 wherein the at least one sensor is a compressor suction temperature sensor that detects a suction temperature of a compressor.

24. The system as recited in claim 14 wherein the data is transmitted from the transmitting computer to the first remote computer over a cellular network.

25. The system as recited in claim 14 wherein the data is transmitted from the first remote computer to the second remote computer over the Internet.

26. The system as recited in claim 14 wherein the data accessed on the second remote computer is in real time.

* * * * *